US009248963B2

(12) United States Patent
Warren

(10) Patent No.: US 9,248,963 B2
(45) Date of Patent: Feb. 2, 2016

(54) INFLATABLE REFUSE CONTAINERS AND METHODS OF USE

(71) Applicant: William J. Warren, Frisco, TX (US)

(72) Inventor: William J. Warren, Frisco, TX (US)

( * ) Notice: Subject to any disclaimer, the term of this patent is extended or adjusted under 35 U.S.C. 154(b) by 0 days.

(21) Appl. No.: 14/275,907

(22) Filed: May 13, 2014

(65) Prior Publication Data

US 2015/0021333 A1 Jan. 22, 2015

Related U.S. Application Data

(60) Provisional application No. 61/855,361, filed on May 14, 2013.

(51) Int. Cl.
*B65F 1/08* (2006.01)
*B65F 1/02* (2006.01)

(52) U.S. Cl.
CPC ... *B65F 1/08* (2013.01); *B65F 1/02* (2013.01); *B65F 2210/13* (2013.01); *B65F 2210/132* (2013.01); *B65F 2220/116* (2013.01)

(58) Field of Classification Search
CPC ..... B65F 1/08; B65F 1/068; B65F 1/06; B65F 1/04; B65F 1/02; B65D 25/18; B65D 25/16; B65D 25/14; B65D 37/00
USPC ..... 220/495.08, 495.06, 9.1–9.4
See application file for complete search history.

(56) References Cited

U.S. PATENT DOCUMENTS 2,751,953 A * 6/1956 Grimm ..... 383/3
3,000,185 A 9/1961 Brinkmann, Jr.
3,039,120 A 6/1962 Powell et al.
3,044,515 A 7/1962 Eades
3,109,184 A 11/1963 Moore, Jr.
3,186,543 A 6/1965 Minick
3,204,866 A * 9/1965 Brighton et al. ..... 232/43.2
3,241,560 A 3/1966 Willat
3,294,223 A 12/1966 Goban
3,556,186 A 1/1971 Besthorne et al.
3,742,994 A 7/1973 Pensak
3,786,526 A 1/1974 Ausseil
3,913,907 A 10/1975 Baker
4,375,809 A 3/1983 Meals
4,384,603 A 5/1983 Tyrer et al.
4,612,781 A 9/1986 Swerdon (Continued)

FOREIGN PATENT DOCUMENTS

EP 374360 6/1990
GB 2314004 12/1997
WO WO 9501294 A1 * 1/1995 ..... B65F 1/04

OTHER PUBLICATIONS

Translation of EP 374360 (Achterberg et al.), Jun. 27, 1990, pp. 3 and 8.

*Primary Examiner* — Robert J Hicks
(74) *Attorney, Agent, or Firm* — Carr & Ferrell LLP

(57) ABSTRACT

The trash container for collecting trash may include an outer container having a first cavity and an inner container being connected to the outer container being positioned within the first cavity. The outer container may include a bottom first wall, opposing first walls, and a back first wall to define the first cavity. The inner container may include a bottom inner wall, the opposing inner sidewalls, and a back inner wall to define a second cavity. The cavity between the walls of the outer container and the inner container would be created. A cavity would be created in between the inner walls also.

13 Claims, 17 Drawing Sheets

(56) References Cited

U.S. PATENT DOCUMENTS

| | | | | |
|---|---|---|---|---|
| 4,809,444 | A | | 3/1989 | Henderson et al. |
| 4,858,755 | A | | 8/1989 | Kuivanen |
| 4,867,576 | A | | 9/1989 | Boyd |
| 4,919,290 | A | | 4/1990 | Wadel |
| 4,941,754 | A | | 7/1990 | Murdock |
| 5,011,137 | A | | 4/1991 | Murphy |
| 5,102,120 | A | | 4/1992 | Lindblad |
| 5,127,523 | A | | 7/1992 | Herdlicka |
| 5,209,364 | A | | 5/1993 | LaPoint, Jr. |
| 5,314,250 | A | | 5/1994 | Lee |
| 5,692,833 | A | | 12/1997 | DeLuca |
| 5,735,495 | A | * | 4/1998 | Kubota ..... 248/100 |
| 6,123,217 | A | | 9/2000 | Miller |
| 6,540,647 | B2 | | 4/2003 | Spooner et al. |
| 6,606,880 | B1 | | 8/2003 | Carlin et al. |
| 6,899,581 | B1 | | 5/2005 | Nokes |
| 8,771,150 | B2 | | 7/2014 | Warren |
| 2005/0066562 | A1 | | 3/2005 | Bober et al. |
| 2013/0172158 | A1 | | 7/2013 | Warren |
| 2013/0225061 | A1 | | 8/2013 | Warren |
| 2013/0225062 | A1 | | 8/2013 | Warren |
| 2013/0316883 | A1 | | 11/2013 | Warren |
| 2015/0023613 | A1 | | 1/2015 | Warren |
| 2015/0076145 | A1 | | 3/2015 | Warren |

* cited by examiner

INFLATABLE REFUSE CONTAINERS AND METHODS OF USE

PRIORITY

The present application claims priority under 35 USC Section 119 based upon U.S. provisional application Ser. No. 61/855,361, which was filed on May 14, 2013.

FIELD OF THE INVENTION

The present invention relates to trash containers and, more particularly, to a trash container having flexible walls.

BACKGROUND

Trash is a common problem around the home, office and outdoors. In order to collect this trash, trash cans have been used. However, these trash cans can be small and generally have rigid sidewalls. The rigid sidewalls prevent the trash cans from being flattened out and stored in a relatively small space. What is needed is a trash can which can be easily deployed and easily stored in a limited space.

SUMMARY

A trash container for collecting trash may include an outer container having a first cavity and an inner container being detachably connected to the outer container and being positioned within the first cavity. The outer container may include a bottom first wall, opposing first side walls and a back first wall to define the first cavity. The inner container may include a bottom inner wall, the opposing inner sidewalls and a back inner wall to define a second cavity.

In some embodiments, the outer container may not have a front wall.

In other embodiments, the inner container may not have a front wall.

According to some embodiments, the outer container may be inflatable by an inflation tube.

In some embodiments, the inner container may be inflatable.

In other embodiments, the inner container may include an inclined wall which extends from the back wall to the bottom wall.

According to some embodiments, the present technology is directed to a trash container, comprising: (a) an outer container forming a first cavity, wherein the outer container is inflatable by an inflation tube; (b) an inner container forming a second cavity, the inner container being disposed within the first cavity in such a way that a sealed space between the inner container and the outer container is created, wherein the sealed space is filled with a fluid; and (c) an interface for introducing or removing the fluid into the sealed space.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
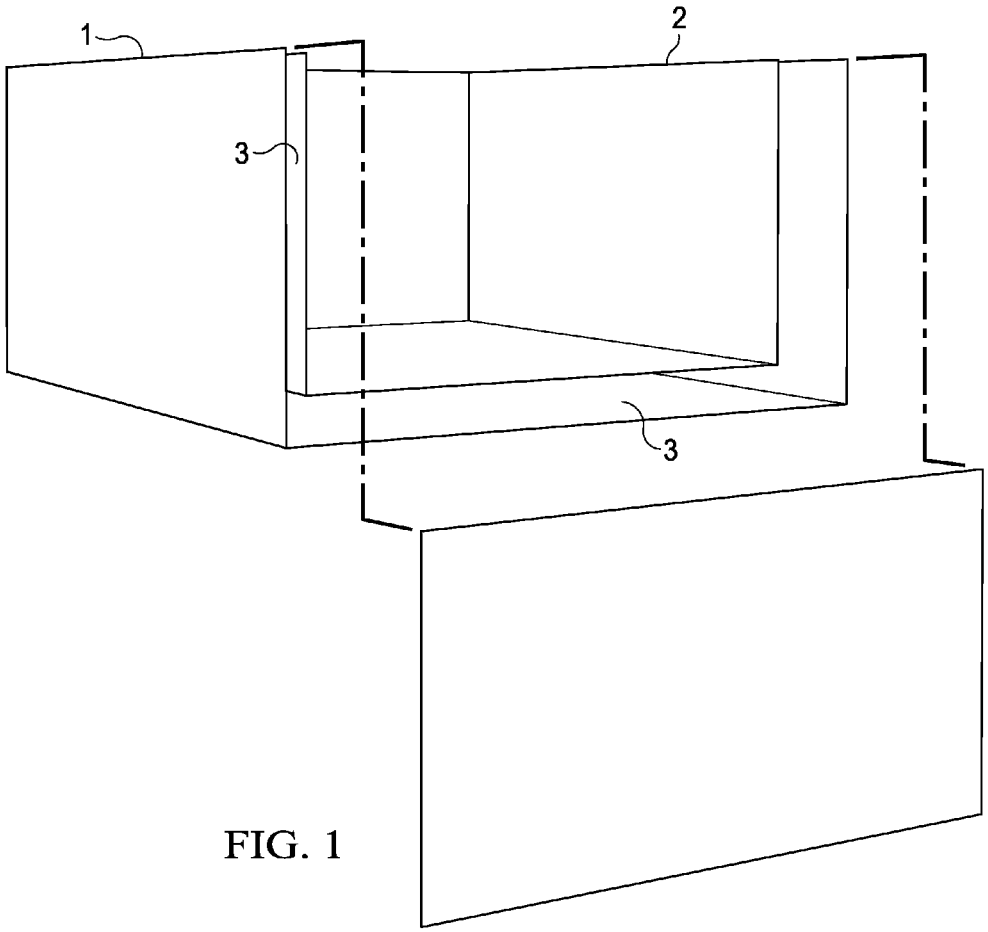
FIG. 1 illustrates a perspective view of the trash container of the present invention.

FIG. 1 is a cross section view of a front of device (trash container), with the front skin (portion of the outer shell) missing. An outer shell 1 is illustrated as well as an inner shell 2. The inner shell and outer shell can be made out of a HEFTY, GLAD (such as disposable plastic refuse bags), biodegradable materials, or any other type of materials to be deemed effective. A space 3 illustrates where the air or liquid or space is received between the outer shell 1 and the inner shell 2.

Figure 2:
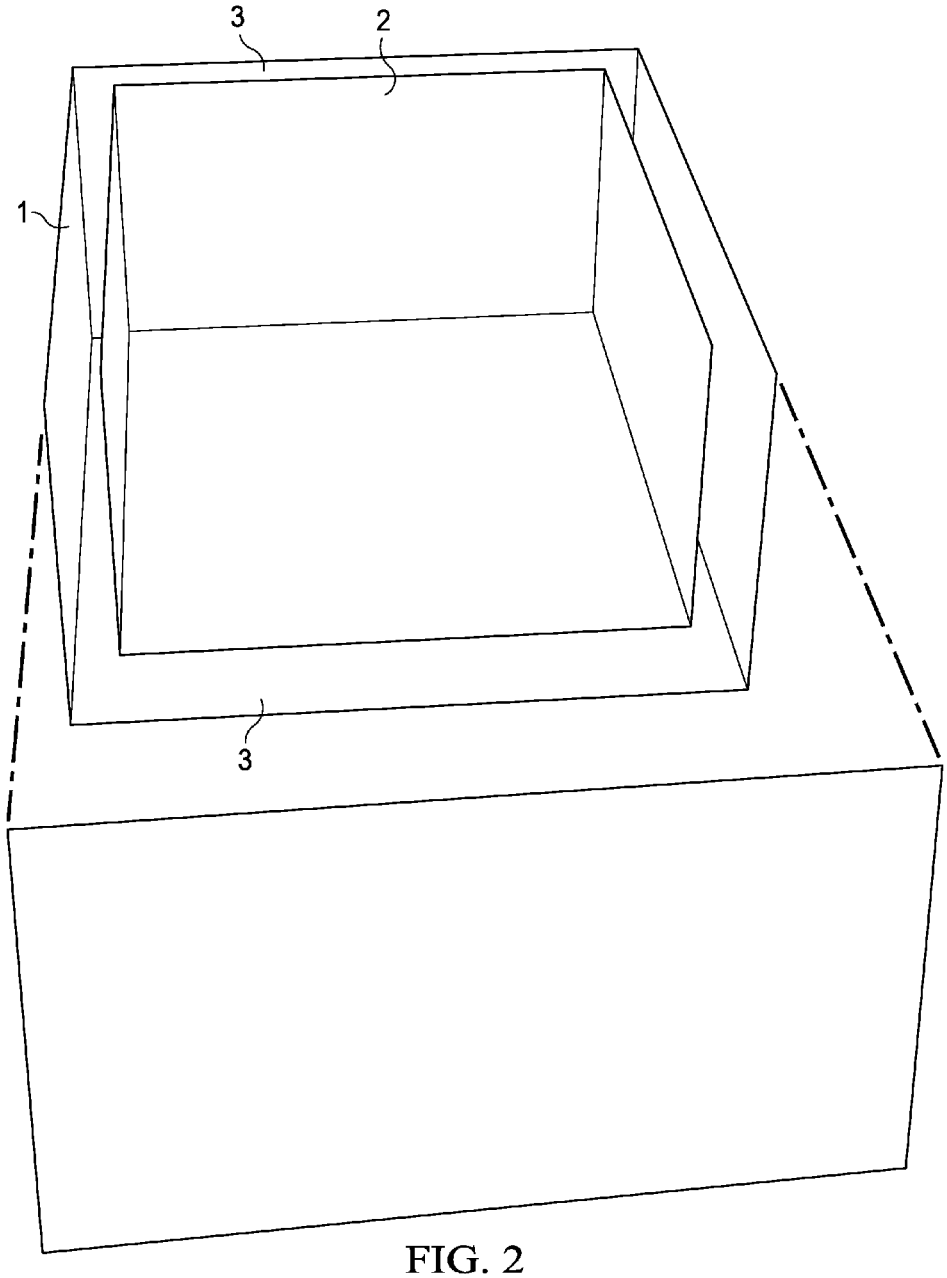
FIG. 2 illustrates a top perspective view of the trash container of the present invention.

FIG. 2 illustrates the space or area 3 from a different perspective. The space 3 is a result of outer shell 1 and inner shell 2 being separated.

Figure 3:
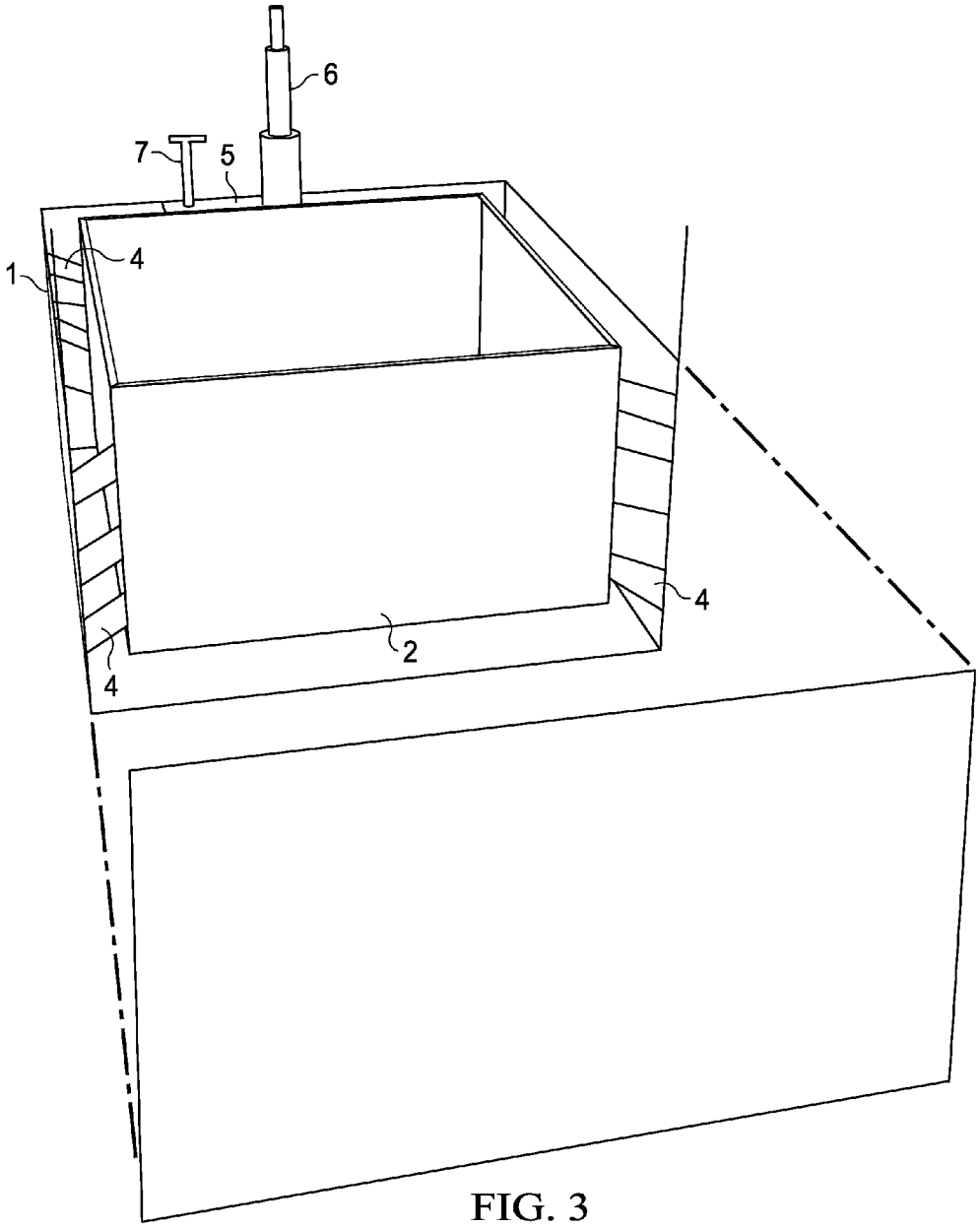
FIG. 3 illustrates a perspective view of the trash container of the present invention.

FIG. 3 illustrates a structural support 4, where the structural support 4 holds the outer shell 1 and inner shell 2 together in a structurally sound manner (as well as air tight) so as to create space 3 for air, water, etc. Structural support 4 is preferably made out of the same material as outer shell 1 and inner shell 2. This combination will create a chamber between shell 1 and shell 2 to trap air or liquid in the space or chamber sealed off on top 5. Support 5 is shown only partially. A blow tube 6 is provided to inflate the space in between outer shell 1 and inner shell 2, which is supported by 5. The blow tube 6 can be inflated by human, a carbon dioxide canister or device, or an electric or manual pump air device. A cleat 7 is provided to tie cords or stings to attach a dog leash.

Figure 4:
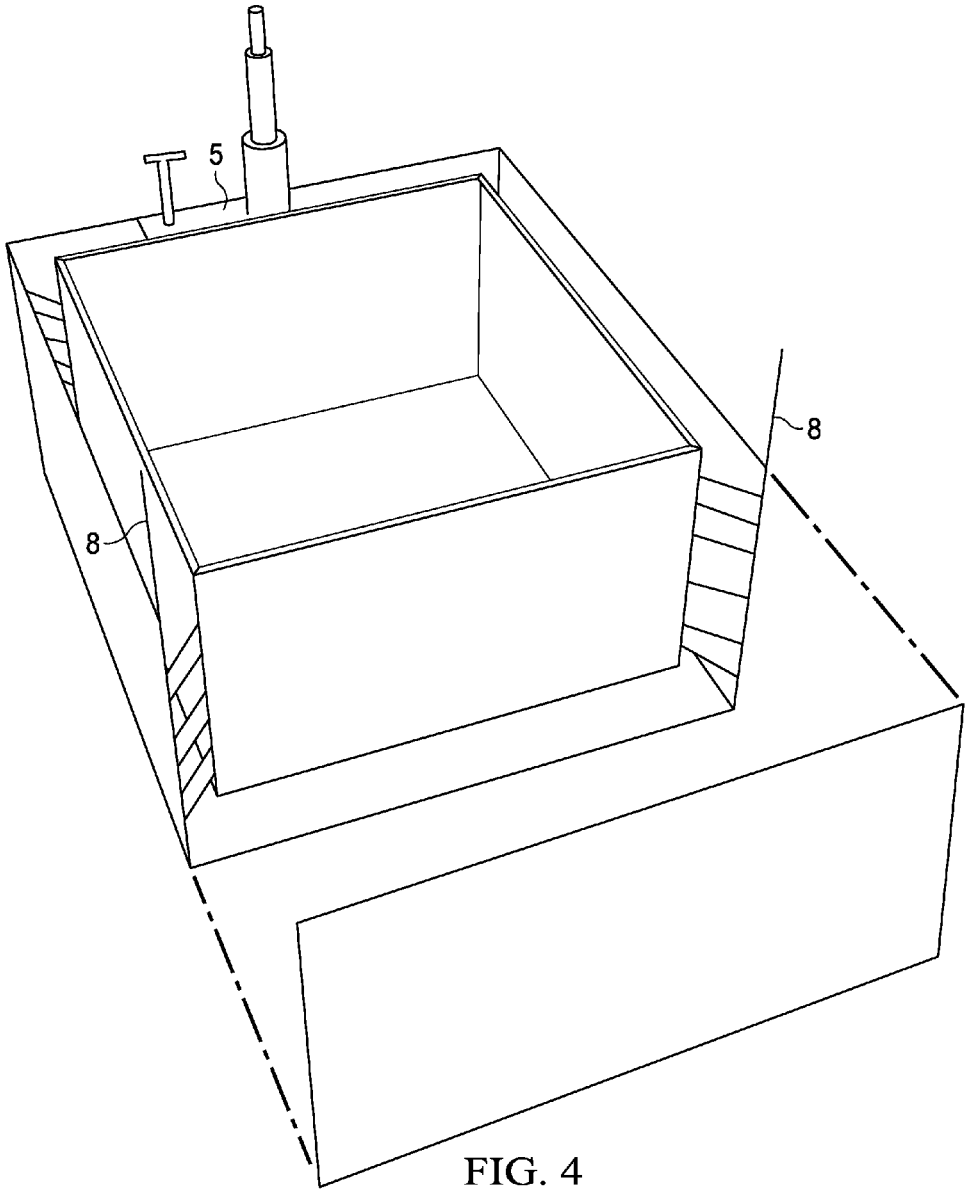
FIG. 4 illustrates a perspective view of the trash container of the present invention.

FIG. 4 illustrates a tie cord 8 which is made of the same material as outer shell 1, inner shell 2, and support 5, for rapid discarding of waste disposed within the trash container.

Figure 5:
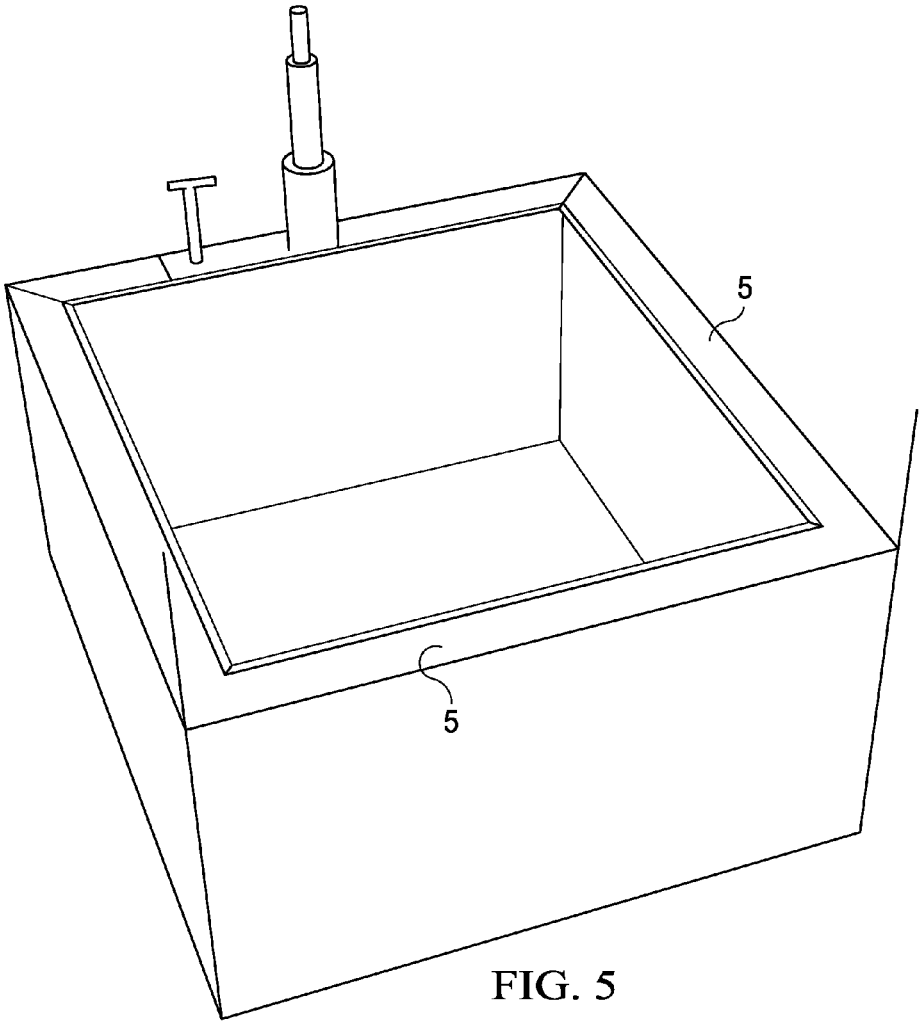
FIG. 5 illustrates a top perspective view of the trash container of the present invention.

FIG. 5 illustrates where support 5 will go around on top of the device.

Figure 6:
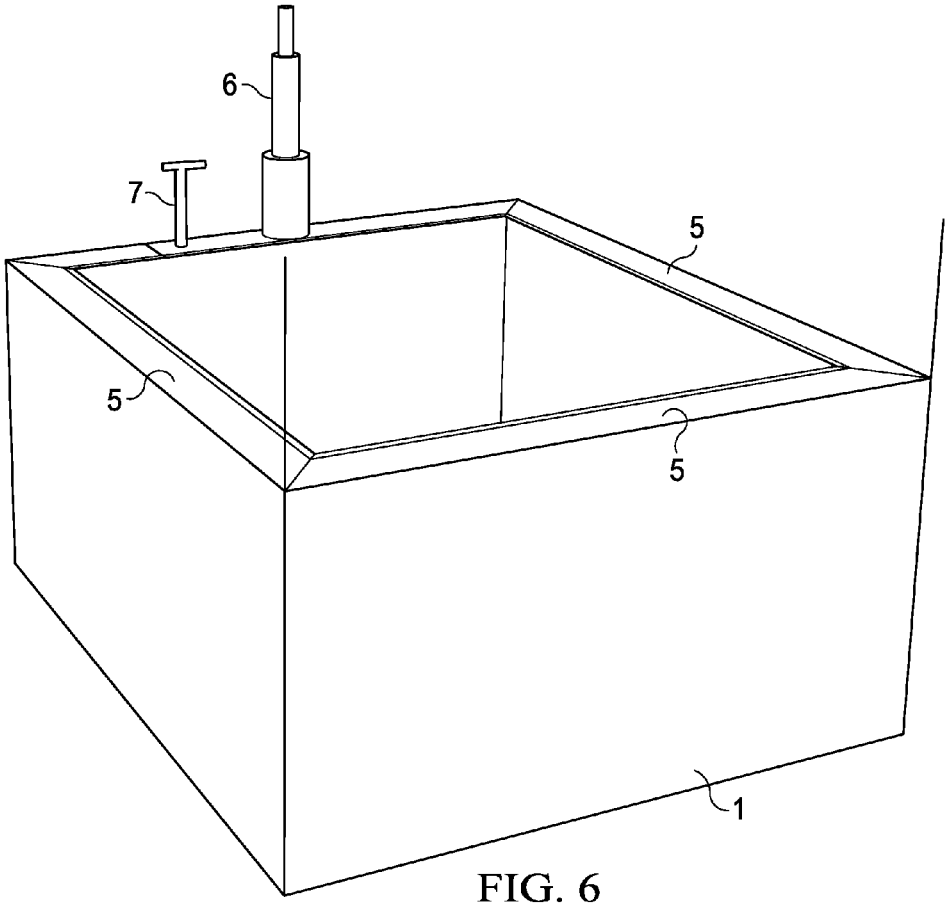
FIG. 6 illustrates a side perspective view of the trash container of the present invention.

FIG. 6 shows the outer shell 1 in place as well as the configuration of the trash container if support 5 and blow tube 6 are placed in combination.

Figure 7:
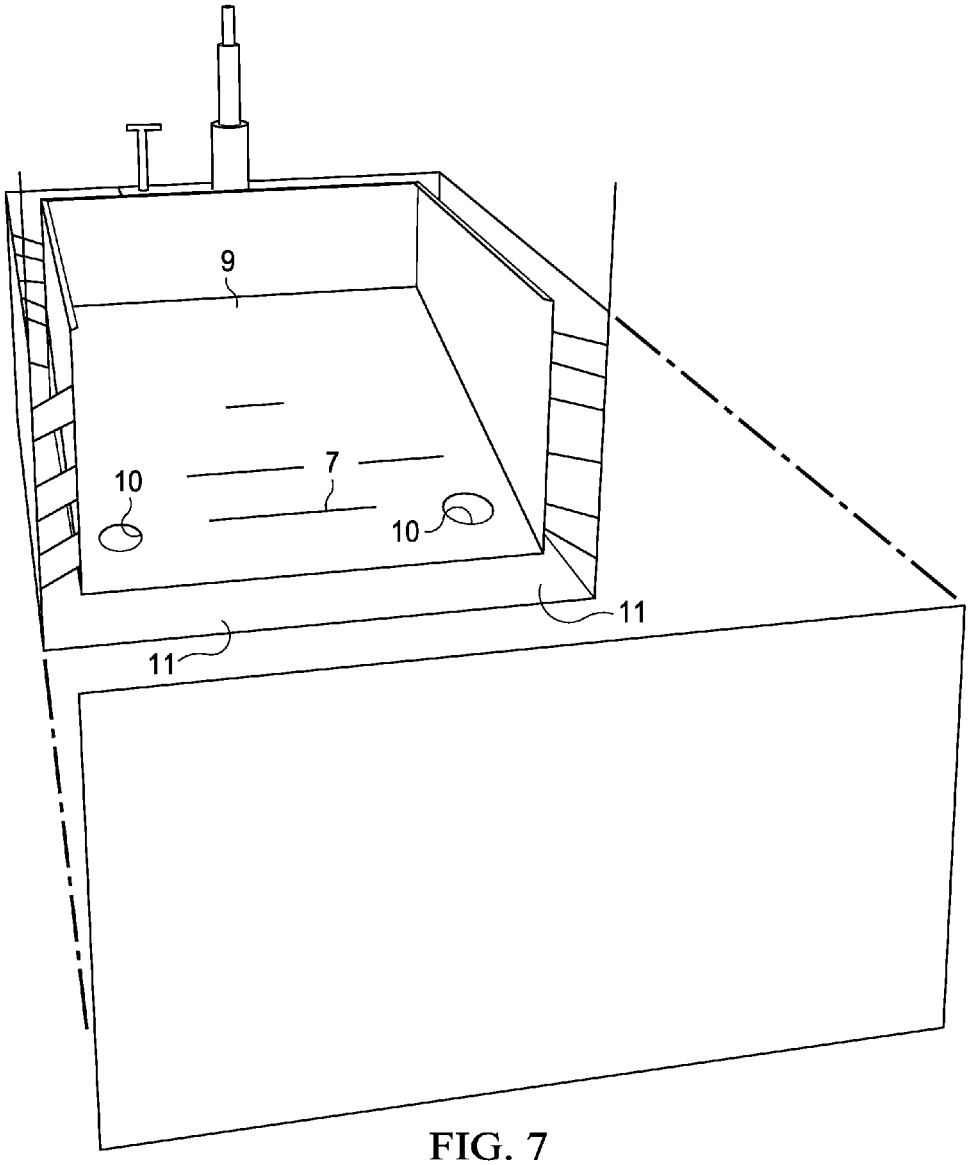
FIG. 7 illustrates a front perspective view of the trash container of the present invention.

FIG. 7 illustrates a floor 9 that is at an incline, which allows solids or liquids to gravitate towards holes or slats 10 created to get trapped in a space or cavity 11. The cavity 11 could receive and retain a liquid or solid absorbing material.

Figure 8:
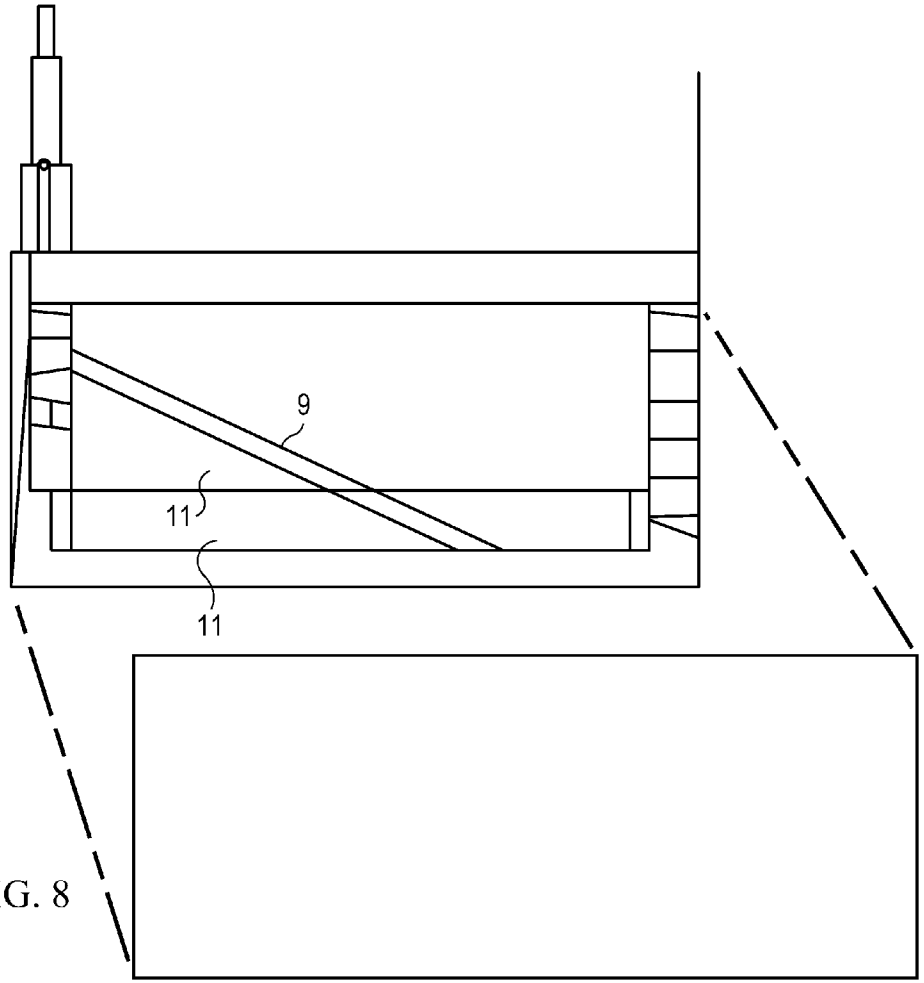
FIG. 8 illustrates a cross-sectional view of the trash container of the present invention.

FIG. 8 illustrates the space or cavity 11 where solids and liquids get trapped. The space or cavity 11 can be provided with a urine absorbing or solid type of absorption material.

Figure 9:
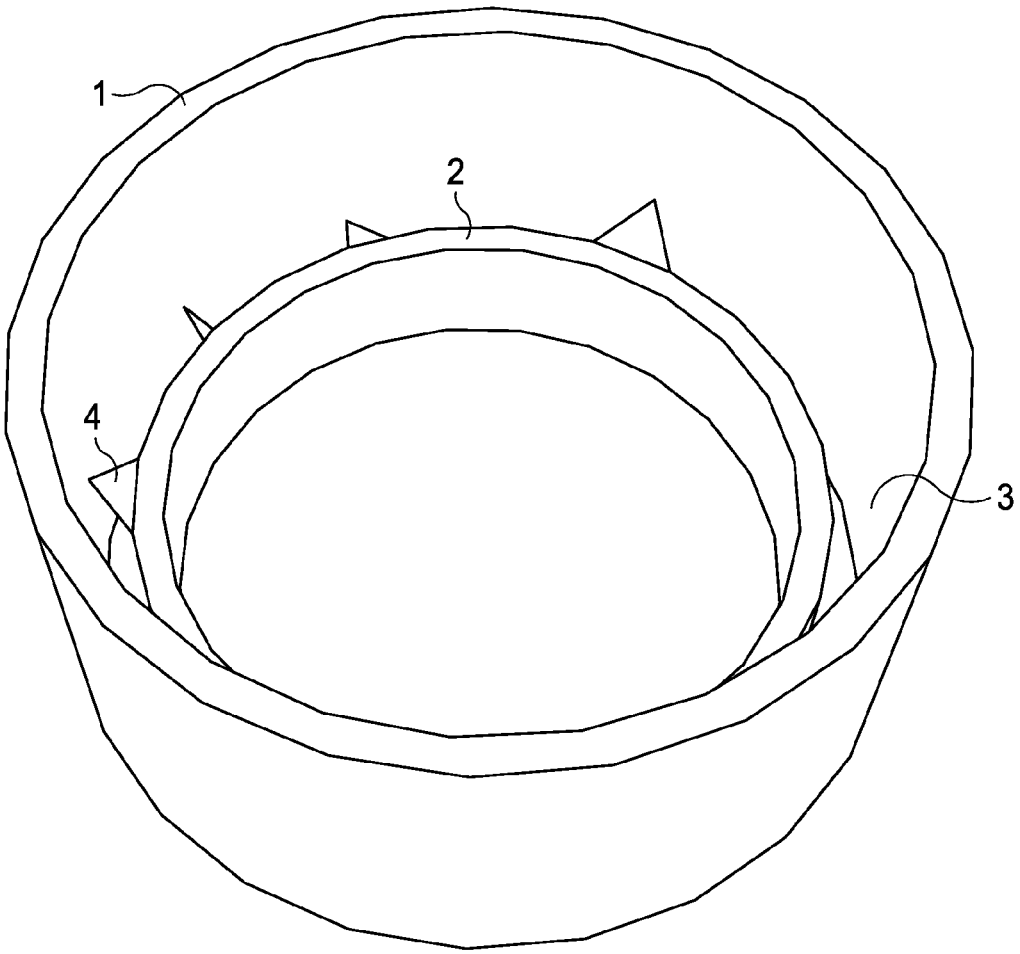
FIG. 9 illustrates a top perspective view of the trash container of the present invention.

FIG. 9 illustrates an outer shell 1 and an inner shell 2, of another example embodiment of a trash container. Material 4 can be utilized to adhere outer shell 1 and inner shell 2 together to form a space 3.

Figure 9A:
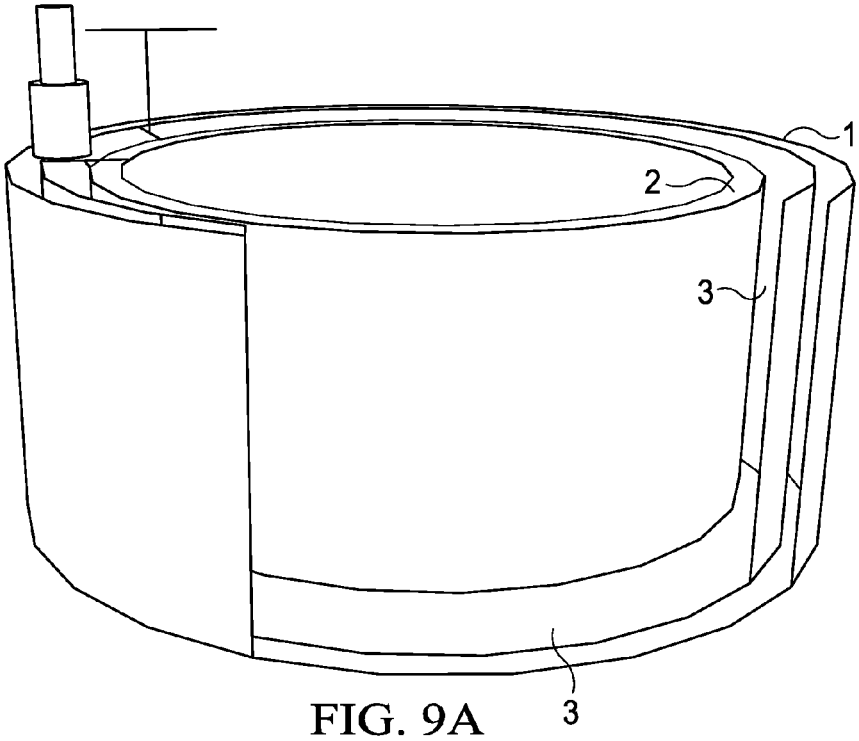
FIG. 9A illustrates a cross-sectional view of the trash container of the present invention.

FIG. 9A shows a cross section with a cutout of outer shell 1 and inner shell 2 with space 3 for air or liquid.

Figure 10:
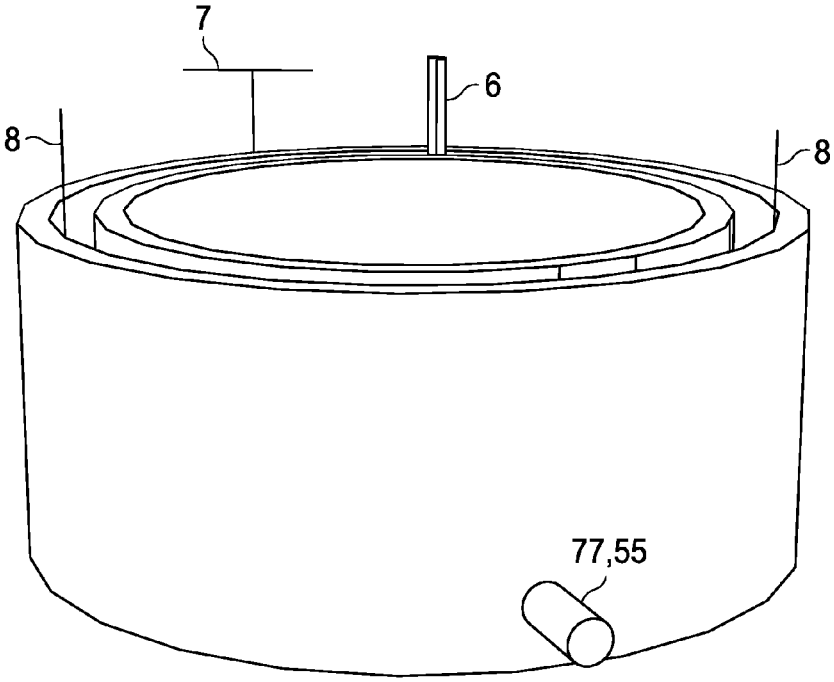
FIG. 10 illustrates a perspective view of the trash container of the present invention.

FIG. 10 illustrates a blow tube 6, shows a cleat 7, as well as the space 3 and a tie cord 8.

Figure 11:
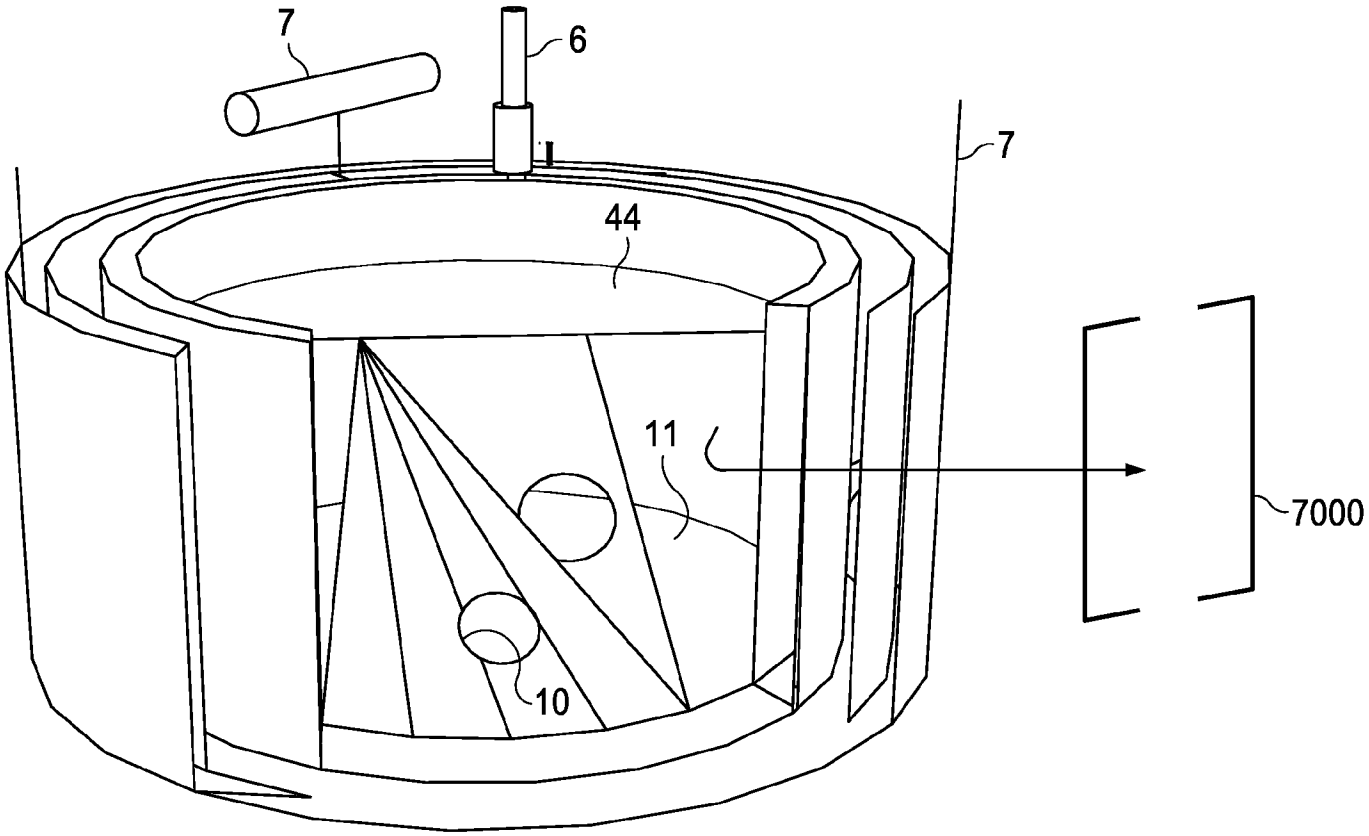
FIG. 11 illustrates a cross-sectional view of the trash container of the present invention.

FIG. 11 illustrates an area 44 that is flat so a pet or any other animal or object can rest thereon. A floor 9 is disposed at an incline. Slots or apertures 10 are provided so that solids or liquids can have access to cavity 11.

Figure 12:
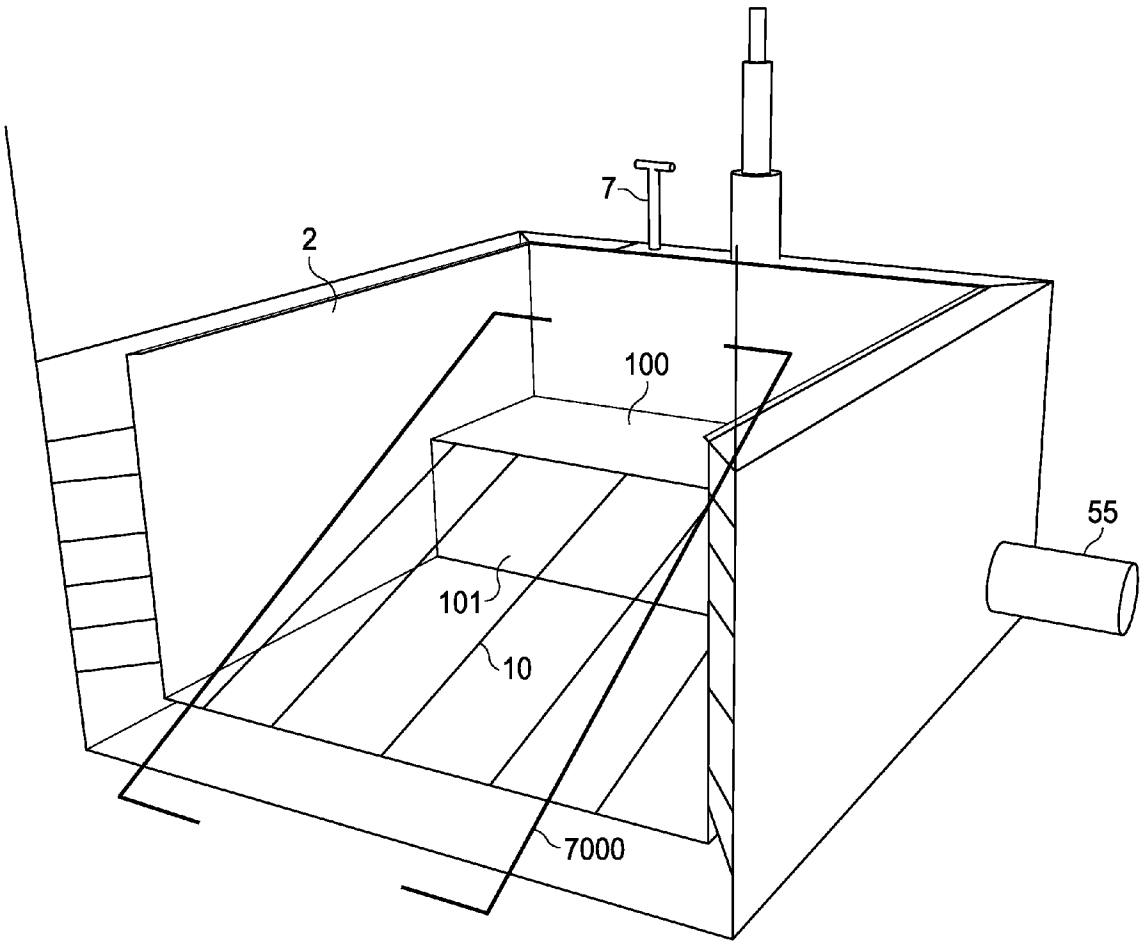
FIG. 12 illustrates a cross-sectional view of the trash container of the present invention.

FIG. 12 is a view of an inflatable support type bench 100 to support an animal, human, etc. An object can be tied to the cleat 7, such that solids and liquids will run by gravity to slats and holes 10. Therefore, a continuous air space 3 is provided for easy blow up and deflation for disposal. An air release valve 55 is provided for air to escape during deflation. An air release valve 55 can be incorporated into any embodiment.

Figure 13:
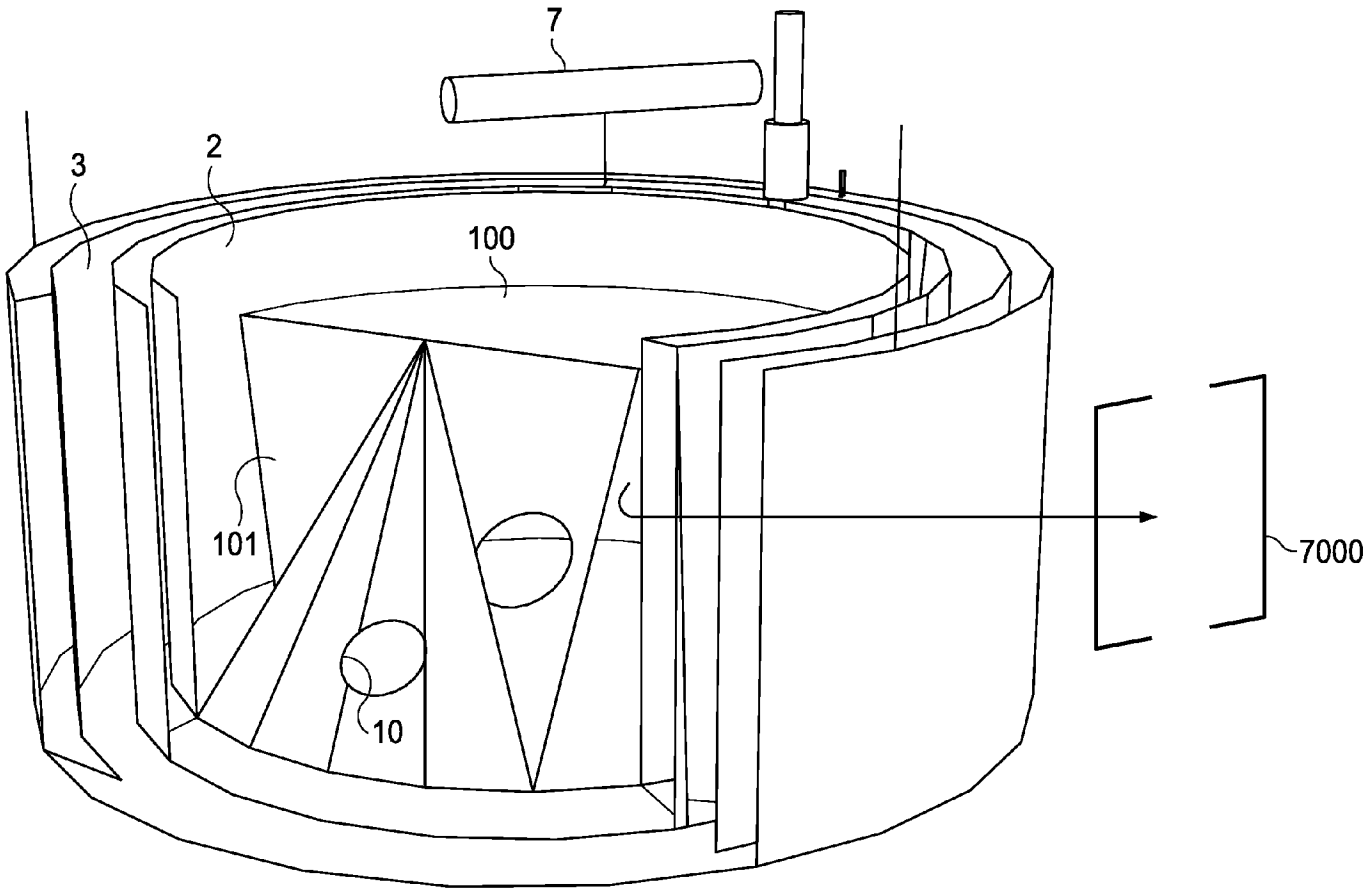
FIG. 13 illustrates a cross-sectional view of the trash container of the present invention.

FIG. 13 is a view of an inflatable support 100 for pets, individuals, and so forth. A cleat tie 7 is also provided as a tie down mechanism. The space 3 underneath the bench will be supported by inflation of the inflatable support 100. A wall 101 is provided to create a chamber within the inflatable support 100 to hold air or liquid to form the bench.

Figure 14:
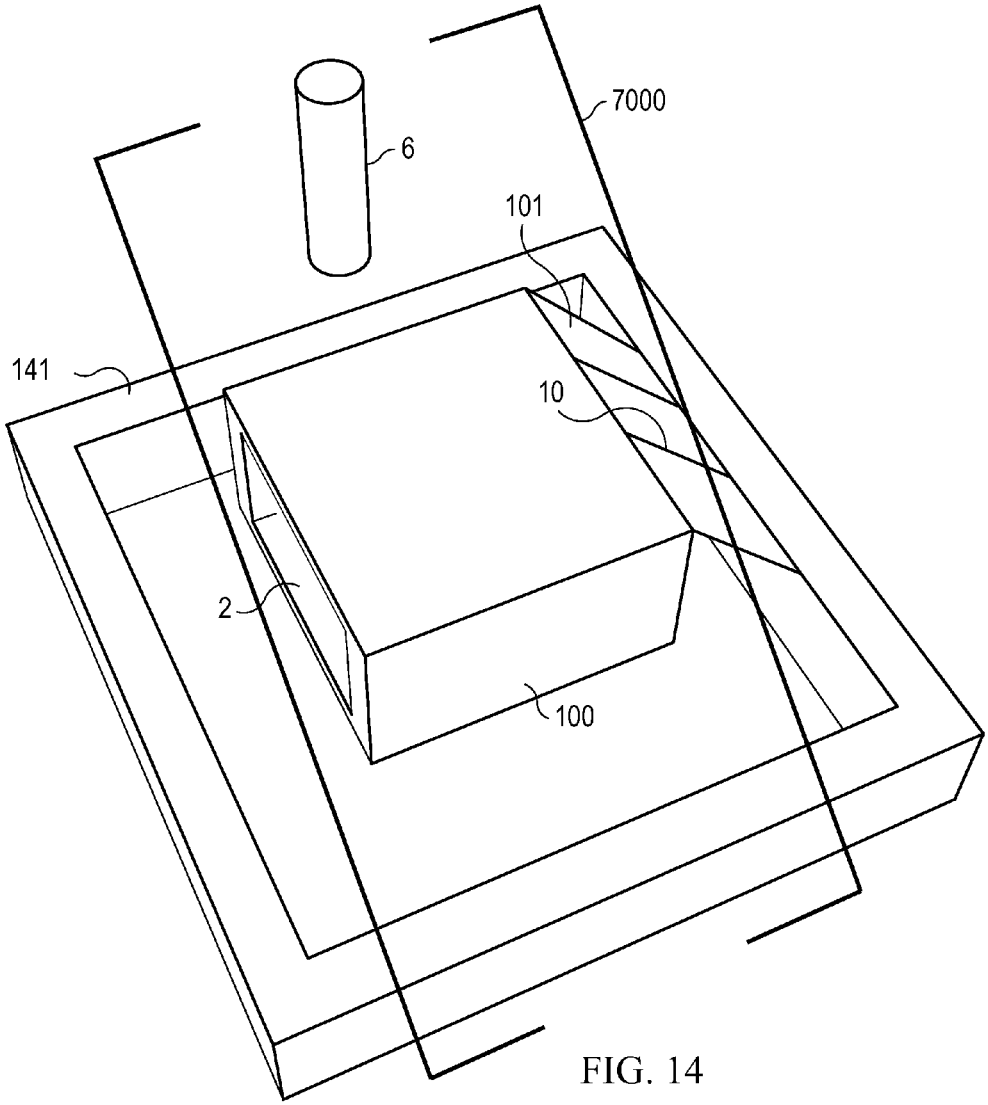
FIG. 14 illustrates a top perspective view of the trash container of the present invention.

FIG. 14 illustrates the cross section of the bench 100. The bench was shown in FIG. 12. By isolating the bench 100, a separate blow tube 6 can be used to inflate the bench. The bench 100 could also be inflated when the frame 1 is inflated. 007 is a bottom floor. The wall 141 is not shown to full height. Wall 141 would be the normal height of trash container. Blow tube 6 is shown to illustrate that bench 100 can be inflated as a stand alone or with the frame 1.

Figure 15:
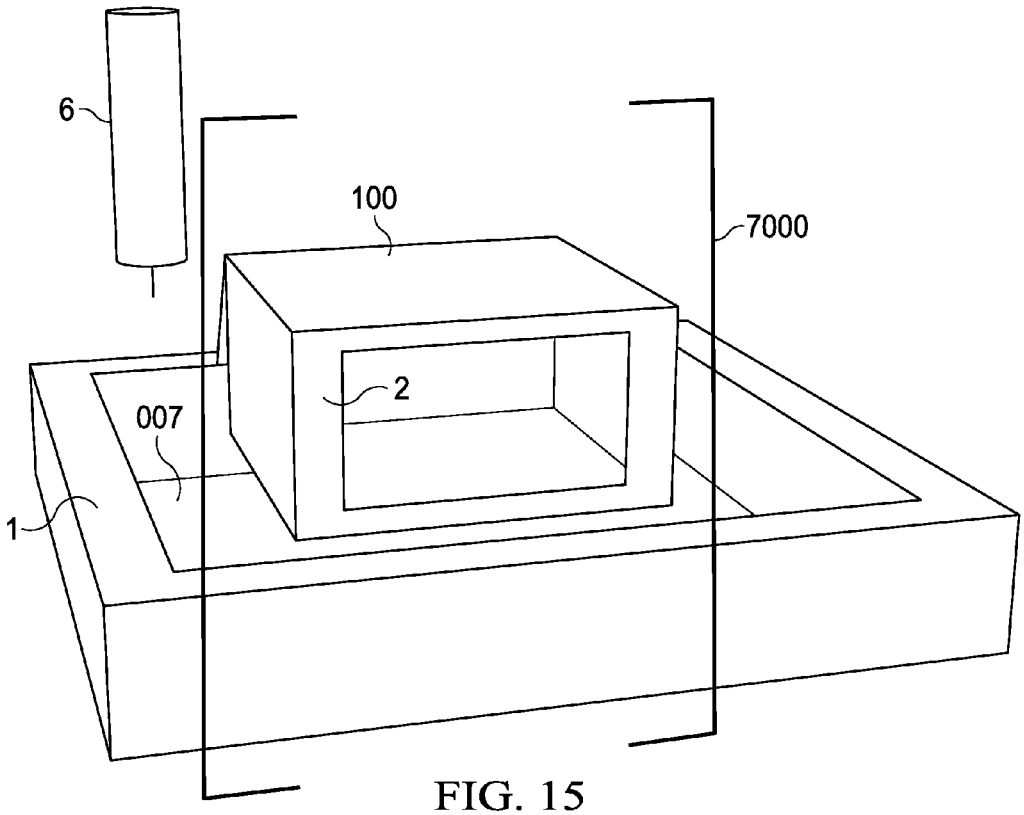
FIG. 15 illustrates an exploded view of the trash container of the present invention.

FIG. 15 is a different angle of FIG. 14. FIG. 15 shows another angle of support for bench inflation system.

Figure 16:
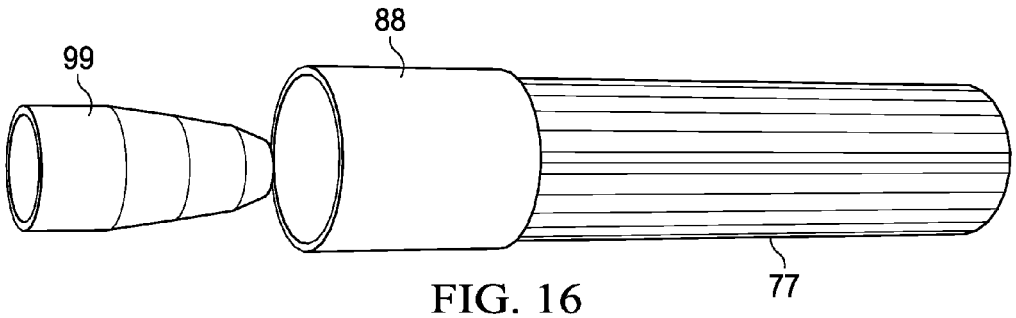
FIG. 16 illustrates a cross-sectional view of the trash container of the present invention.

FIG. 16 demonstrates the blow tube with the regular tube 77 attached to structure for easy blow up, and may or may not be rigid. If not rigid, it can be tied easily to cut off escaping air or, after being tied, it can be cut to release the air. A rigid piece 88 allows for air machines, $CO_2$, or any other devices to inflate the structure. A cap 99 is provided in some embodiments.

Figure 17:
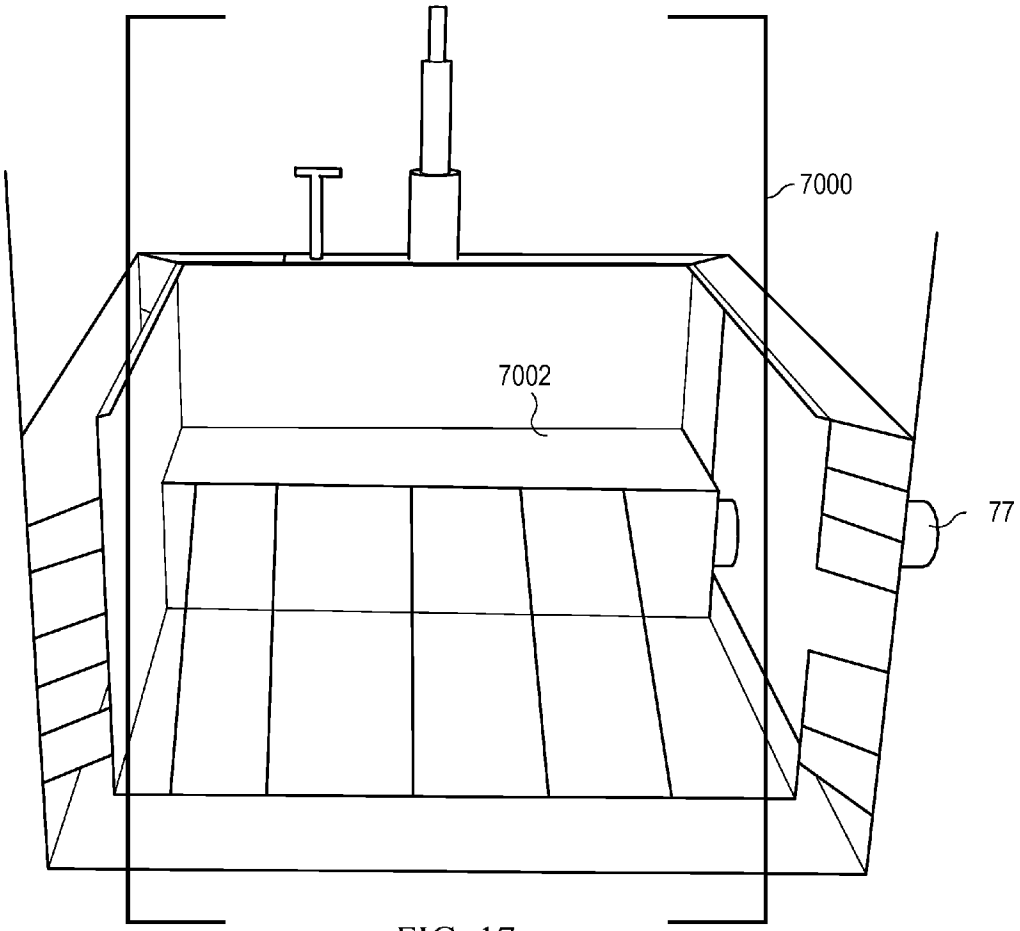
FIG. 17 illustrates a front perspective view of the trash container of the present invention.

FIG. 17 illustrates the view of the pet bench 7002, which is provided in some embodiments. A quick air or liquid release tube 77 releases air from the bench 7002 by cutting of the tube 77.

Figure 18:
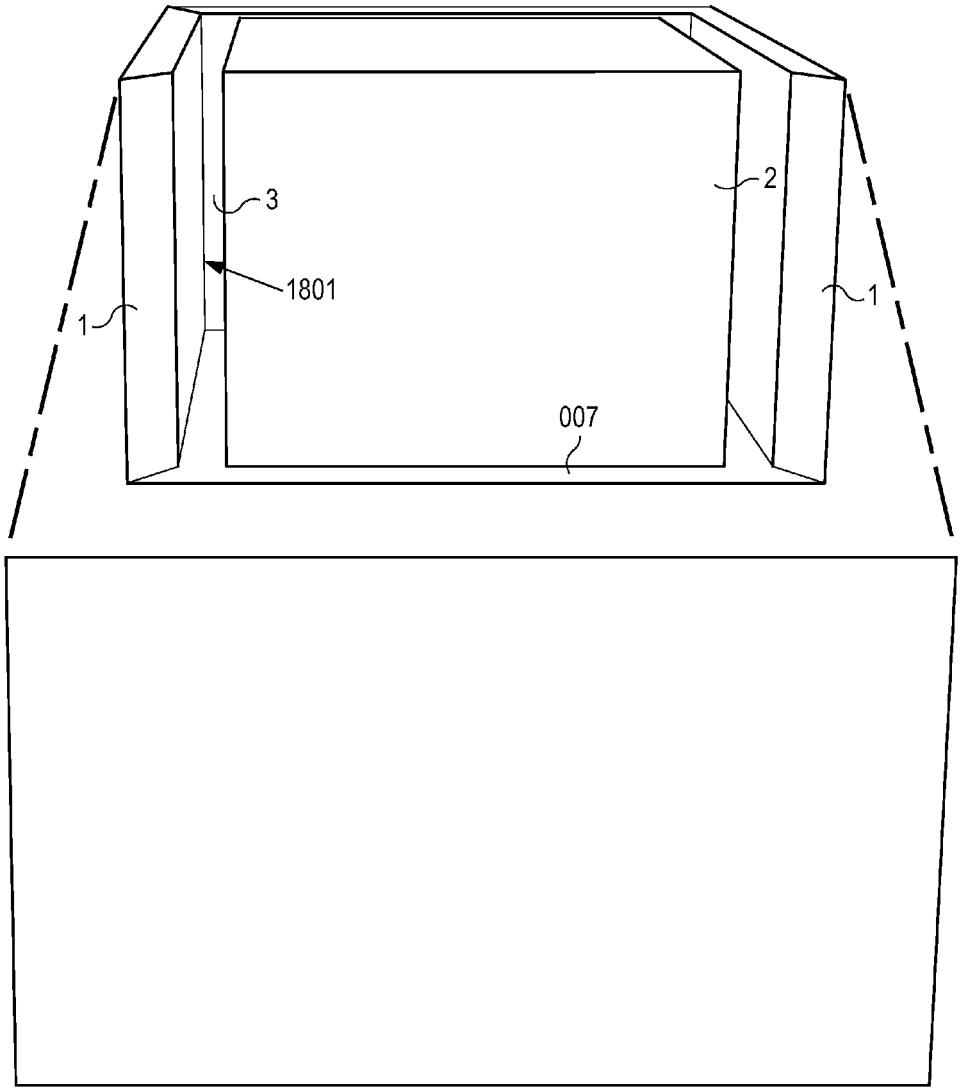
FIG. 18 illustrates a front perspective view of the trash container of the present invention.

*FIG. 18 illustrates outer shell 1 and inner shell 2 with no air or liquid space in between outer shell 1 and inner shell 2 to form 007 on the bottom.

*This may or may not exist with all systems. The two shells 1 and 2 are essentially joined as one unit to form a bottom support for systems. Air or liquids will be filled within the periphery 1801 to support the system.

*ALL OF THE INFLATION SYSTEMS MAY OR MAY NOT HAVE GROUND SUPPORT SYSTEMS

An example bracket 7000 is illustrated in FIG. 14 that shows the "bench support". The true function is to illustrate the isolation of the support or bench support to fit under any secondary floor that is not the lowest floor. The support is there to hold an animal on top so solids and fluids run down secondary floor. As illustrated in other drawings, there will be holes in secondary floor. This is shown in FIG. 7, the inclined floor 9 and the holes, apertures, or slits. The bench location is also shown in FIG. 17. The bench is 100.

FIG. 15 is another angle of FIG. 14. Inclined floor 007 has a view from underneath with holes in the material to let out waste to flow to bottom floor. The isolation of the bench 100 is one advantage of the present technology illustrated in FIG. 15.

**ALL DEVICES COULD OR COULD NOT HAVE QUICK DEFLATING TUBES LOCATED ANYWHERE ON INFLATION SYSTEMS.

According to some embodiments, such as the embodiment of FIG. 1, an example trash container can comprise an outer container forming a first cavity by outer shell 1. In some embodiments, the outer container is inflatable by an inflation tube. An inner container forms a second cavity by use of inner shell 2. The inner container is disposed within the first cavity in such a way that a sealed space (space 3) between the inner container and the outer container is created. The sealed space is filled with a fluid such as air. In some embodiments, the trash container comprises an interface for introducing or removing the fluid into the sealed space. An air release valve mounted on a sidewall of the outer container, such as valve 77, 55 of FIG. 10, and valve 55 of FIG. 12, just as a few examples.

In some embodiments, the interface is disposed on a top of the trash container that seals the sealed space by extending between the outer container and the inner container. In some embodiments, a cleat tie is disposed on the top of the trash container and adjacent to the interface.

As mentioned above, in some embodiments, a floor 9 of the inner container 2 is sloped towards holes 10 extending through the inner container 2. The holes 10 provide a path for communication of fluids out of the trash container or into a lower holding chamber of the trash container.

In some embodiments, an absorbent material can be disposed in a space underneath the holes 10 such as space or cavity 11.

According to some embodiments, sections of material are disposed within the sealed space to join the inner container 2 with the outer container 1.

An inflatable bench, such as bench 100 of FIG. 12 (or the bench illustrated in FIG. 17) can be formed from an inflatable support wall forming an inflatable support. In some embodiments, a blow tube can be included on the trash container for inflating the inflatable support wall.

In some embodiments, such as FIGS. 9-11, the inner container and the outer container are both cylindrical and the sealed space is an annular ring.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

The invention claimed is:

1. A trash container, comprising:

an outer container forming a first cavity, wherein the outer container is inflatable by an inflation tube;

an inner container forming a second cavity, the inner container being disposed within the first cavity in such a way that a sealed space between the inner container and the outer container is created, wherein the sealed space is filled with a fluid, a floor of the inner container is sloped towards holes extending through the inner container, the holes providing a path for communication of fluids;

an interface for introducing or removing the fluid into the sealed space, wherein the interface is disposed on a top of the trash container that seals the sealed space by extending between the outer container and the inner container; and a cleat tie disposed on the top of the trash container and adjacent to the interface.

2. The trash container according to claim 1, further comprising an absorbent material disposed in a space underneath the holes.

3. The trash container according to claim 1, further comprising sections of material disposed within the sealed space to join the inner container with the outer container.

4. The trash container according to claim 1, further comprising an inflatable bench formed from an inflatable support wall forming an inflatable support.

5. The trash container according to claim 4, further comprising an air release valve mounted on a sidewall of the outer container.

6. The trash container according to claim 4, further comprising a blow tube for inflating the inflatable support.

7. The trash container according to claim 1, wherein the inner container and the outer container are both cylindrical and the sealed space is an annular ring.

8. A trash container, comprising:

an outer container forming a first cavity, wherein the outer container is inflatable by an inflation tube;

an inner container forming a second cavity, the inner container being disposed within the first cavity in such a way that a sealed space between the inner container and the outer container is created, wherein the sealed space is filled with a fluid;

an inflatable bench formed from an inflatable support wall forming an inflatable support; and an interface for introducing or removing the fluid into the sealed space.

9. The trash container according to claim 8, further comprising an air release valve mounted on a sidewall of the outer container.

10. The trash container according to claim 8, further comprising a blow tube for inflating the inflatable support.

11. The trash container according to claim 8, wherein the inner container and the outer container are both cylindrical and the sealed space is an annular ring.

12. The trash container according to claim 8, further comprising an absorbent material disposed in a space underneath holes extending through the inner container.

13. The trash container according to claim 8, further comprising sections of material disposed within the sealed space to join the inner container with the outer container.

* * * * *